US005592990A

United States Patent [19]

Ben-Dosa

[11] Patent Number: 5,592,990

[45] Date of Patent: Jan. 14, 1997

[54] CLEANING SYSTEM FOR CLEANING FLUID-CONDUCTING TUBING

[75] Inventor: Chaim Ben-Dosa, Herzliya, Israel

[73] Assignee: Ball-Tech Energy Ltd., Rosh Ha'Ayin, Israel

[21] Appl. No.: 504,742

[22] Filed: Jul. 20, 1995

[30] Foreign Application Priority Data

Jul. 25, 1994 [IL] Israel ..... 110445

[51] Int. Cl.[6] ..... F28G 1/12

[52] U.S. Cl. ..... 165/95; 15/3.51; 165/DIG. 4

[58] Field of Search ..... 165/95, 11.1; 15/3.5, 15/3.51

[56] References Cited

U.S. PATENT DOCUMENTS

| | | | |
|---|---|---|---|
| 3,882,931 | 5/1975 | Kumagai | 165/95 |
| 4,544,027 | 10/1985 | Goldberg et al. | 165/95 |
| 4,578,838 | 4/1986 | Prinz | 15/3.51 X |
| 4,694,892 | 9/1987 | Borchert | 165/95 |
| 4,865,121 | 9/1989 | Ben-Dosa | 165/95 |
| 4,984,629 | 1/1991 | Voith et al. | 165/95 |
| 5,010,950 | 4/1991 | Voith | 165/95 |
| 5,176,204 | 1/1993 | Ben-Dosa | 165/95 |

FOREIGN PATENT DOCUMENTS

| | | | |
|---|---|---|---|
| 1247359 | 8/1967 | Germany | 165/95 |
| 280890 | 10/1993 | Japan | 165/95 |
| 296687 | 11/1993 | Japan | 165/95 |

*Primary Examiner*—Leonard R. Leo
*Attorney, Agent, or Firm*—Ladas & Parry

[57] ABSTRACT

A cleaning system for cleaning tubing by balls circulated with the fluid through tubing, includes a ball collector housing having an apertured partition permitting the fluid, but not the balls, to pass therethrough, so that the balls accumulate in the upper compartment and are recirculated into the tubing by controlling various valves. The upper compartment is closed by a removable cover to permit adding balls to the upper compartment or removing balls therefrom.

18 Claims, 3 Drawing Sheets

CLEANING SYSTEM FOR CLEANING FLUID-CONDUCTING TUBING

FIELD AND BACKGROUND OF THE INVENTION

The present invention relates to a cleaning system for cleaning fluid-conducting tubing. The invention is particularly useful in a condenser for cleaning the tubing of a heat-exchanger used in such a condenser, and the invention is therefore described below with respect to this application.

The invention is especially directed to the type of cleaning system described in U.S. Pat. Nos. 4,865,121 and 5,176,204. Such cleaning systems include balls circulated with the fluid through the tubing from its upstream side to its downstream side, separator means for separating the balls from the fluid at the downstream side of the tubing, and recirculating means for recirculating the balls back to the upstream side of the tubing. In U.S. Pat. No. 5,176,204, the separator is in the form of a hollow perforated tube enclosed within a housing connected by a passageway to the downstsream side of the tubing. In one embodiment, the hollow perforated tube is carried by an ejector operable to eject the balls accumulated on the outer surface of the perforated tube into the upstream side of the tubing; and in a second embodiment, the separator further includes two valves, in the inlet and outlet sides of the collector housing, open by actuators to eject the balls into the upstream side of the tubing.

Systems of this type generally require a separate reservoir for adding balls to the system or removing balls from the system for replacement purposes, and also for viewing the condition of the balls in the system. Such a reservoir, including the accompanying valves for selectively connecting the reservoir into and out of the system, significantly increases the overall cost of the system.

OBJECTS AND BRIEF SUMMARY OF THE INVENTION

An object of the present invention is to provide a cleaning system for cleaning fluid-conducting tubing which has advantages in the above respects.

According to the present invention, there is provided a cleaning system for cleaning tubing used for conducting a fluid therethrough, which system includes balls circulated with the fluid through the tubing from its upstream side to its downstream side, separator means for separating the balls from the fluid at the downstream side of the tubing, and recirculating means for recirculating the balls back to the upstream side of the tubing; the recirculating means comprising: a ball collector housing having an apertured partition therein permitting the fluid, but not the balls, to pass therethrough, and dividing the interior of the housing into an upper compartment and a lower compartment; a first passageway connecting one side of the upper compartment to the downstream side of the tubing; a second passageway connecting a first point on the opposite side of the upper compartment to a first point in the upstream side of the tubing; a third passageway connecting a second point on the opposite side of the upper compartment to a second point in the upstream side of the tubing to receive a pressure slightly lower than that at the first point in the upstream side of the tubing but higher than that at the downstream side of the tubing; a fourth passageway connecting the lower compartment to a source of lower pressure than that at the downstream side of the tubing as well as at the first and second points in the upstream side of the tubing; valves in the first, second, third and fourth passageways controlling the fluid flow therethrough; and a cover covering the upper compartment and removable therefrom to permit adding balls to the upper compartment or removing balls therefrom.

As will be described more particularly below, such a cleaning system eliminates the need for a separate reservoir in order to introduce balls into the system, or remove balls from the system, since the system enables the collector housing in the recirculating means also to serve this function. This feature thus significantly reduces the overall cost of the system.

According to a further feature in the described preferred embodiment, the cover is transparent to permit viewing the contents of the upper compartment of the collector housing, particularly the quantity and condition of the balls therein.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
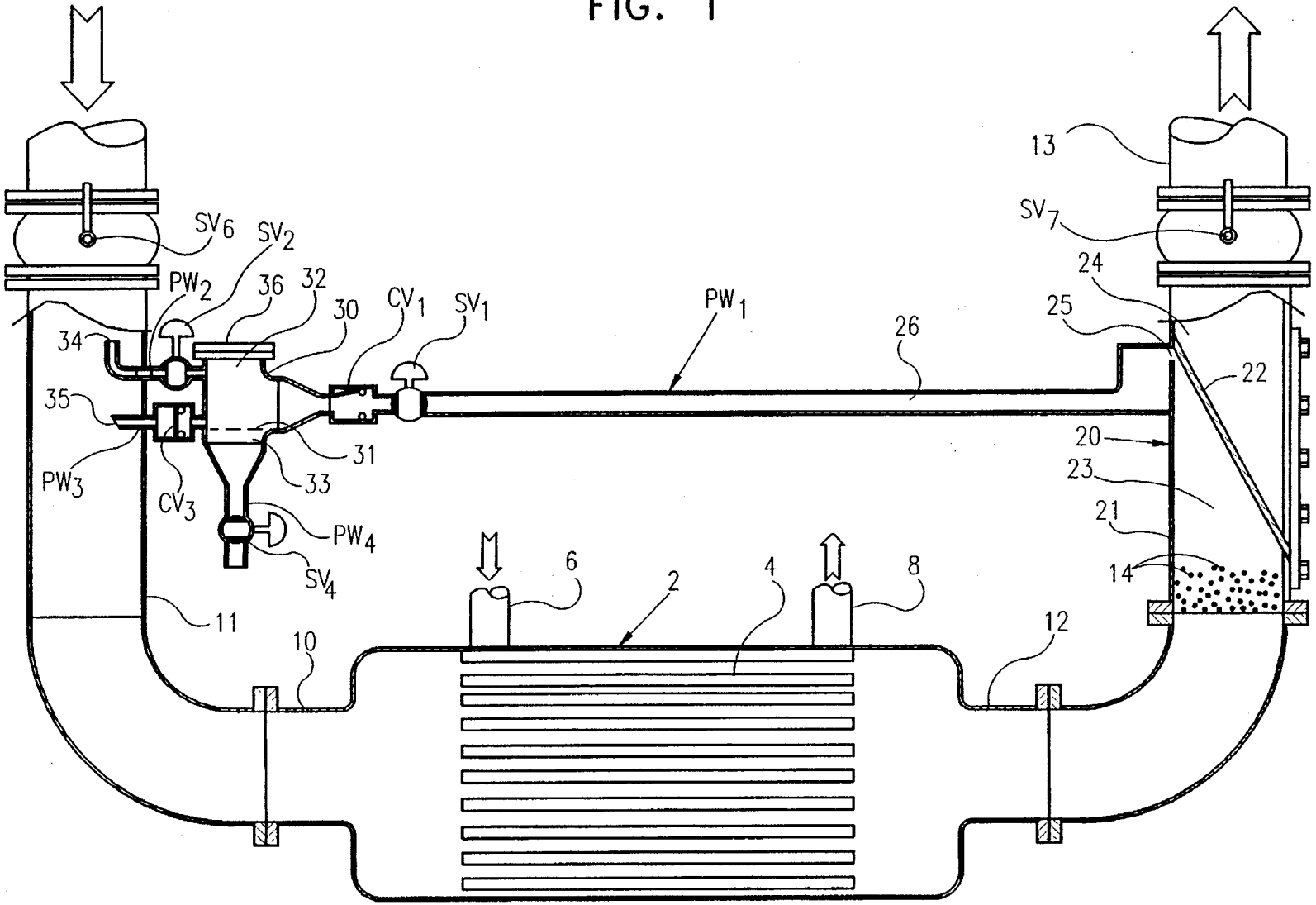
FIG. 1 illustrates one form of cleaning system constructed in accordance with the present invention.

The cleaning system illustrated in the drawings comprises a condenser 2 including tubing 4 in the form of a plurality of parallel, spaced tubes, through which a cooling liquid, such as water, is passed in order to condense a fluid, such as steam or a refrigerant gas, circulating from an inlet 6 through the spaces between the condenser tubing 4 to an outlet 8. The cooling liquid is circulated through the condenser tubing 4 from an inlet header 10 connected to the upstream side of the condenser tubing by an inlet pipe 11, to an outlet header 12 connected at the downstream side of the tubing by an outlet tube 13.

The cooling liquid includes a plurality of cleaning balls 14 forced through the tubing 4 with the cooling liquid to prevent the lodging or settling of particles within the condenser tubing 4 which would tend to clog or erode the tubing. Balls 14 are made of a spongy material of slightly larger diameter than the condenser tubing 4 so that they rub against the inner walls of the tubing and thereby maintain them clean. This technique of using cleaning balls for cleaning tubing in condensers and other forms of heat-exchangers is well known, and therefore details of such a cleaning system, or of the balls 14 used in this type of system, are not set forth herein.

A ball separator, in the form of a ball trap generally designated 20, is interposed between the outlet header 12 in the outlet tube 13. Ball trap 20 includes a housing 21 having a grid 22 dividing the interior of the housing into a first chamber 23 communicating with the outlet header 12, and a second chamber 24 communicating with the outlet tube 13. Ball trap housing 21 is further formed with an exit opening 25 communicating with a bypass tube 26 leading back to the inlet tube 11 at the upstream side of the condenser tubing 4.

Grid 22 has openings therein to separate the balls 14 flowing with the cooling liquid and to pass only the liquid to the outlet tube 13. The balls 14 thus accumulate within chamber 23 of the ball trap. As described below, the balls are recirculated into the upstream side of the condenser tubing 4 by means of recirculating means which includes the bypass tube 26.

The recirculating means further includes a housing 30 having an apertured partition 31 dividing the interior of the housing into a first compartment 32 and a second compartment 33 on opposite sides of the partition. Partition 31 may be an apertured screen. It permits the fluid, but not the balls, to pass through it so that the balls accumulate within compartment 32.

Bypass tube 26 constitutes a first passageway $PW_1$ and connects the upper compartment 32 of housing 30 to the downstream side of the condenser tubing 4 via ball trap 20. A second passageway $PW_2$ connects an upper point of the opposite side of the upper compartment 32 to a point 34 in the upstream tube 11 at the upstream side of condenser tubing 4; and a third passageway $PW_3$ connects a lower point of the upper compartment 32 also to the upstream tube 11 but at a point 35 slightly downstream from the point at which passageway $PW_2$ is connected. In addition, the end of passageway $PW_3$ projecting into the inlet tube 11 at point 35 is cut at a bias to produce a lower pressure therein than the pressure in passageway $PW_2$.

Collector housing 30 includes a further passageway $PW_4$ connecting the lower chamber 33 of the housing to the atmosphere, or to a portion of the system which is at a lower pressure than that in any of the passageways $PW_1$, $PW_2$ or $PW_3$.

Passageway $PW_1$ includes a shut-off valve $SV_1$ which may be manually or automatically controlled to shut off the flow of the liquid therethrough. Passageway $PW_1$ also includes a check valve $CV_1$, which permits flow of the liquid from passageway $PW_1$ into compartment 32 of collector housing 30, but not vice versa.

Passageway $PW_2$ also includes a shut-off valve $SV_2$, which may be manually or automatically controlled to shut-off the flow of liquid via that passageway. Passageway $PW_3$ includes a check valve $CV_3$ which permits liquid flow only in the direction from the collector housing 30 into the inlet tube 11, and not vice versa. Passageway $PW_4$ includes a shut-off valve $SV_4$ which may also be manually or automatically controlled to shut-off the flow of the liquid therethrough.

The illustrated system further includes a shut-off valve $SV_6$ in the inlet tube 11, and a shut-off valve $SV_7$ in the outlet tube 13.

As will be described more particularly below, the collector housing 30, which serves to collect the balls being recirculated back into the inlet side of the condenser tubing 4, also serves as a reservoir for adding balls thereto or for removing balls therefrom. For this purpose, housing 30 includes a cover 36 covering the upper compartment 32 and removable therefrom in order to add or remove balls. Cover 36 is transparent to enable one to readily view the contents of compartment 32, not only the quantity of balls therein, but also their condition to determine whether they should be replaced.

Figure 2:
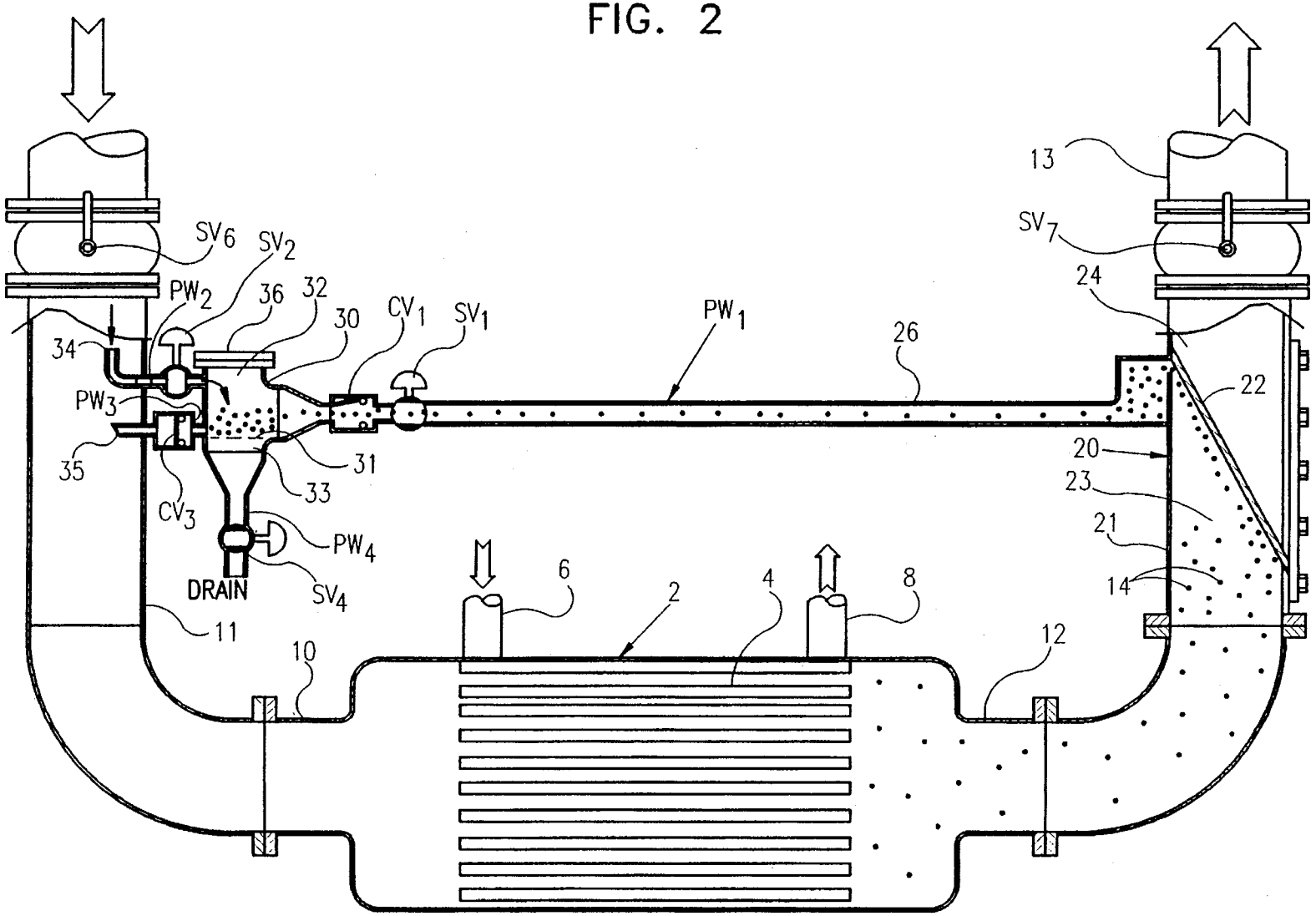
FIGS. 2 and 3 illustrate the system of FIG. 1 during different operating conditions of the system.
Figure 3:
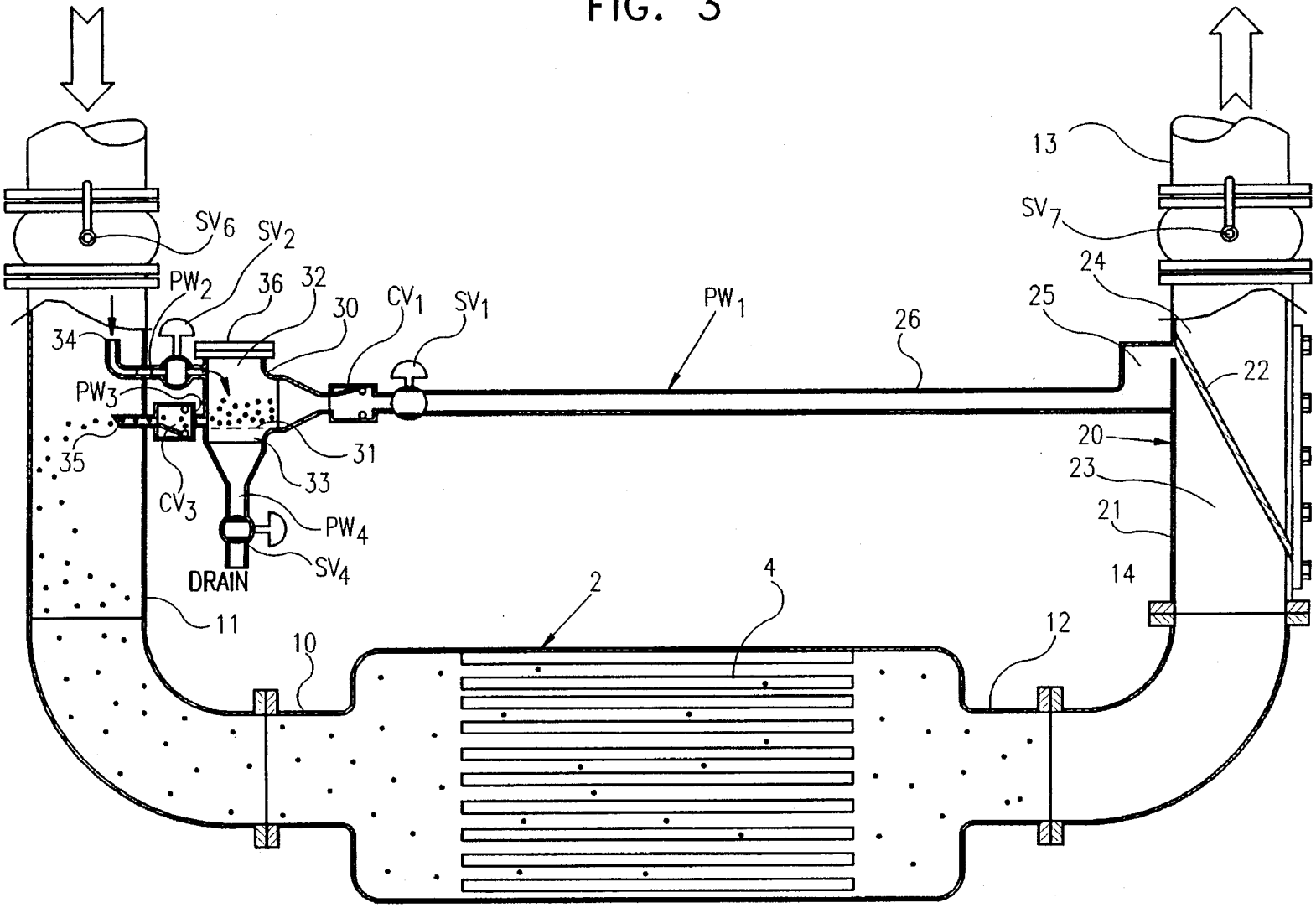

The operation of the system illustrated in FIG. 1 will now be described particularly with reference to FIGS. 2 and 3.

During normal operation of the system, valves $SV_6$ and $SV_7$ are open, and valve $SV_1$ is closed, so that the balls 14 would be circulated through the condenser tubing 4 but would accumulate within compartment 23 of ball trap 20. This is the condition illustrated in FIG. 1, wherein it will be seen that not only valve $SV_1$ is closed, but also valves $SV_2$ and $SV_4$ are closed.

When it is desired to recirculate the balls accumulating within compartment 23 of the ball trap 20 back into the inlet side of the condenser tubing 4, valve $SV_1$ in passageway $PW_1$ and valve $SV_4$ in passageway $PW_4$ are both opened, while valve $SV_2$ in passageway $PW_2$ remains closed. This is the condition illustrated in FIG. 2. The low pressure within passageway $PW_4$ will therefore draw the balls from compartment 23 of the ball trap 20 via exit opening 25 of the ball trap, the enlarged-volume section 27 of passageway $PW_1$, and tube 26 of the latter passageway, into the collector housing 30 and out through passageway $PW_4$. Screen 31 within collector housing 30 prevents the balls 14 from passing out through passageway $PW_4$, so that the balls accumulate within the upper compartment 32 of the collector housing, and also within the enlarged-volume section 27 of passageway $PW_1$ adjacent to the exit opening 25 of the ball trap 20. This direction of flow of the cooling liquid with the balls 14 is permitted by check valve $CV_1$ within passageway $PW_1$.

Valve $SV_4$ within passageway $PW_4$ is now closed, and valve $SV_2$ within passageway $PW_2$ is opened. This is the condition illustrated in FIG. 3. The higher pressure in passageway $PW_2$ at point 34 in the inlet tube 11, as compared to the lower pressure at the biassed-cut end of passageway $PW_3$ at point 35 in the inlet tube 11, produces a flow of the liquid via passageway $PW_2$, compartment 32 of collector housing 30, and passageway $PW_3$ into the inlet tube 11, this direction of flow being permitted by check valve $CV_3$ in passageway $PW_3$. Accordingly, the balls 14 which accumulated within the upper compartment 32 of the collector housing 30, as well as those accumulating within tube 26 and enlarged-volume section 27 of passageway $PW_1$, will now be drawn with the liquid into the inlet pipe 11 for recirculation through the condenser tubing 4.

When the balls 14 have thus been reintroduced into the inlet tube 11, valves $SV_1$ in passageway $PW_1$, and valve $SV_2$ in passageway $PW_2$ are closed, thereby returning the system to its original condition as illustrated in FIG. 1.

The condition of the balls 14 within compartment 32 of housing 30 may be continuously inspected via the transparent cover 36. Whenever desired, the cover may be removed in order to add balls 14 into compartment 32, or to remove worn balls from that compartment for replacement by fresh balls.

It has been found that the provision of the enlarged-volume section 27 within passageway $PW_1$ provides additional volume for accumulating the balls during the time valve $SV_4$ in passageway $PW_4$ is open, and thereby reduces the quantity of liquid passing through passageway $PW_4$, e.g., for collecting the balls preparatory to their being re-introduced into the inlet tube 11. Passageway $PW_4$ may be connected to atmosphere, or to a low-pressure point in the system, such as in the upstream (negative-pressure) end of a circulating pump (not shown) for circulating the liquid through the system.

While the invention has been described with respect to one preferred embodiment, it will be appreciated that this is set forth merely for purposes of example, and that many other variations, modifications and applications of the invention may be made.

I claim:

1. A cleaning system for cleaning tubing used for conducting a fluid therethrough, which system includes balls circulated with the fluid through the tubing from its upstream side to its downstream side, separator means for separating the balls from the fluid at the downstream side of the tubing, and recirculating means for recirculating the balls back to the upstream side of the tubing; said recirculating means comprising:

a ball collector housing having an interior containing an apertured partition permitting the fluid, but not the balls, to pass therethrough, and dividing the interior of the housing into an upper compartment and a lower compartment;

a first passageway connecting one side of said upper compartment to the downstream side of said tubing;

a second passageway connecting a first point on an opposite side of said upper compartment to a first point in the upstream side of said tubing;

a third passageway connecting a second point on said opposite side of the upper compartment to a second point in the upstream side of said tubing to receive a pressure slightly lower than that at said first point in the upstream side of said tubing but higher than that at said downstream side of the tubing;

a fourth passageway connecting said lower compartment to a source of lower pressure than that at said downstream side of the tubing as well as at said first and second points in the upstream side of the tubing;

valves in said first, second, third and fourth passageways controlling the fluid flow therethrough;

and a cover covering said upper compartment and removable therefrom to permit adding balls to said upper compartment or removing balls therefrom.

2. The system according to claim 1, wherein said cover is transparent to permit viewing the interior of said upper compartment.

3. The system according to claim 1, wherein said separator means comprises a ball trap having a housing connected to the downstream side of the tubing, and a grid located in the ball trap housing to define a ball collector compartment communicating with the downstream side of the tubing for collecting the balls exiting therethrough with the fluid, said ball trap housing including an exit opening from said ball collector compartment to said first passageway.

4. The system according to claim 3, wherein said grid is mounted at an incline across the ball trap housing to form an acute angle therewith adjacent said exit opening to said first passagewway.

5. The system according to claim 4, wherein said first passageway is formed with an enlarged-volume section adjacent said exit opening in the ball trap housing for accumulating balls therein.

6. The system according to claim 1, wherein said valves include a shut-off valve in said first passageway, and a check valve in said first passageway permitting flow only into said upper compartment of the housing from the downstream side of the tubing, and not out of said upper compartment into the downstream side of the tubing.

7. The system according to claim 1, wherein said valves include a check valve in said third passageway permitting flow only out of said upper compartment into the upstream side of the tubing, and not into said upper compartment from the upstream side of the tubing.

8. The system according to claim 1, wherein said valves include a shut-off valve in said second passageway.

9. The system according to claim 1, wherein said valves include a shut-off valve in said fourth passageway.

10. The system according to claim 1, wherein said fourth passageway is connected to atmospheric pressure.

11. A cleaning system for cleaning tubing used for conducting a fluid therethrough, which system includes balls circulated with the fluid through the tubing from its upstream side to its downstream side, separator means for separating the balls from the fluid at the downstream side of the tubing, and recirculating means for recirculating the balls back to the upstream side of the tubing; said recirculating means comprising:

a ball collector housing having an interior containing an apertured partition permitting the fluid, but not the balls, to pass therethrough, and dividing the interior of the housing into an upper compartment and a lower compartment;

a first passageway connecting one side of said upper compartment to the downstream side of said tubing;

a second passageway connecting a first point on an opposite side of said upper compartment to a first point in the upstream side of said tubing;

a third passageway connecting a second point on said opposite side of the upper compartment to a second point in the upstream side of said tubing to receive a pressure slightly lower than that at said first point in the upstream side of said tubing but higher than that at said downstream side of the tubing;

a fourth passageway connecting said lower compartment to the atmosphere;

valves in said first, second, third and fourth passageways controlling the fluid flow therethrough;

and a transparent cover covering said upper compartment and removable therefrom to permit adding, removing and viewing the contents of said upper compartment.

12. The system according to claim 11, wherein said separator means comprises a ball trap having a housing connected to the downstream side of the tubing, and a grid located in the ball trap housing to define a ball collector compartment communicating with the downstream side of the tubing for collecting the balls exiting therethrough with the fluid, said ball trap housing including an exit opening from said ball collector compartment to said first passageway.

13. The system according to claim 12, wherein said grid is mounted at an incline across the ball trap housing to form an acute angle therewith adjacent said exit opening to said first passagewway.

14. The system according to claim 13, wherein said first passageway is formed with an enlarged-volume section adjacent said exit opening in the ball trap housing for accumulating balls therein.

15. The system according to claim 11, wherein said valves include a shut-off valve in said first passageway, and a check valve in said first passageway permitting flow only into said upper compartment of the housing from the downstream side of the tubing, and not out of said upper compartment into the downstream side of the tubing.

16. The system according to claim 11, wherein said valves include a check valve in said third passageway permitting flow only out of said upper compartment into the upstream side of the tubing, and not into said upper compartment from the upstream side of the tubing.

17. The system according to claim 11, wherein said valves include a shut-off valve in said second passageway.

18. The system according to claim 11, wherein said valves include a shut-off valve in said fourth passageway.

* * * * *